United States Patent [19]

Carver

[11] Patent Number: 4,890,738

[45] Date of Patent: Jan. 2, 1990

[54] COLLAPSIBLE DISPLAY CARRIER AND METHOD OF MAKING

[75] Inventor: Robert G. Carver, Ashland, Ohio

[73] Assignee: Coburn, Inc., Ashland, Ohio

[21] Appl. No.: 364,265

[22] Filed: Jun. 9, 1989

[51] Int. Cl.[4] ..... B65D 85/44

[52] U.S. Cl. ..... 206/434; 53/462

[58] Field of Search ..... 206/426, 427, 429, 434; 53/461, 462

[56] References Cited

U.S. PATENT DOCUMENTS

| | | | |
|---|---|---|---|
| 4,381,057 | 4/1983 | Carver | 206/426 |
| 4,640,417 | 2/1987 | Durand | 206/426 |
| 4,735,314 | 4/1988 | Kadleck et al. | 206/426 |

*Primary Examiner*—William Price

*Attorney, Agent, or Firm*—Renner, Otto, Boisselle & Sklar

[57] ABSTRACT

A display carrier for glassware or the like is foldable from a generally flat, collapsed condition for shipping and storage to an erect position for retaining at least a pair of articles. The carrier is formed of a flexible material which forms a top wall, a bottom wall and a pair of side walls, each side wall being hinged to each of the top and bottom walls to form a carrier sleeve. A reinforcing wall extends between the top and bottom walls. Planar retaining tabs are resiliently connected along a foldline of the top and bottom walls, and each tab is contoured to match a part of the surface of the article to be carried. Bights in the reinforcing wall limit movement of the retaining tabs. When the carrier is folded flat, the reinforcing wall holds the tabs flat against the top and bottom walls to which they are hinged. The carrier may also include a lift tab which lifts the retaining tabs from the flat position against the top and bottom walls to a position in which they bear against a respective bight. The method of making the carrier from a blank is also disclosed.

24 Claims, 8 Drawing Sheets

COLLAPSIBLE DISPLAY CARRIER AND METHOD OF MAKING

FIELD OF THE INVENTION

The present invention relates to a display carrier which is easy to assemble and fill with articles to be displayed such as glassware.

BACKGROUND OF THE INVENTION

Glassware is frequently sold in cardboard containers which wrap around two, four or possibly more glasses and hold them without allowing them to clink together. Typically, the containers have a top, a pair of sides and a bottom joined together to form a sleeve surrounding the glasses. Glasses are put in the sleeve in a side-by-side arrangement. A reinforcing wall extends vertically from the top to the bottom to separate the pairs of glasses and to keep the bottom from sagging. Additional tabs keep the adjacent glasses of each pair from touching. When glassware is ready for shipping, a worker assembles the cardboard container and puts the appropriate number of glasses in it.

One such container is shown in U.S. Pat. No. 4,735,314 to Kadleck et al. The Kadleck et al. container arrives at the glassware factory in a flattened state with retaining tabs extending outward from the top and bottom panels. In order to fill the container, a worker must erect it and insert the glassware. Once the glassware is in place, the worker must fold locking tabs at the top and bottom of the container through about a 135° angle and insert them into narrow slots in the reinforcing wall. Each narrow slot prevents the locking tab captured in the slot from moving in either direction. Manipulating the locking tabs into these narrow slots is time consuming and tiresome.

SUMMARY OF THE INVENTION

The present invention provides a display carrier which is substantially easier to use than the prior art carriers. Manual manipulation of the locking tabs is eliminated by a design which automatically positions the locking tabs as the carrier is erected. Specifically the present invention provides a central reinforcing panel with bights, as contrasted with the prior art slots. A tab is associated with each bight and hinged to the edge of the respective top or bottom panel. In its operative position each tab is at an angle to its panel and presses against the edge of its bight. With the tab thus inclined to the plane of its panel, outward movement of the glassware within is blocked.

According to the present invention the carrier is manufactured with the retaining tabs folded flat against the top and bottom panels. In a further aspect of the present invention a mechanism is provided positively to lift the retaining tabs hinged to the bottom panels. To this end lift tabs are die cut from the bottom panel and hinged to it. Part of the lift tab is glued to the central reinforcing panel. As the carton is erected, the lift tabs rise from the plane of the bottom panel and pry the retaining tabs into an operative position where they retain glassware in the carrier.

In another aspect of the invention the carrier is formed from a unitary, planar cardboard blank which is die cut and creased to form all the various panels and tabs of the carrier. The blank has an upper and lower retaining tab extending laterally from each side, bights formed in the central reinforcing panel, and cutouts formed in the bottom. In a first folding operation the retaining tabs are each folded 180° along longitudinal fold lines so that they lie flat against the panels to which they are hinged. Next glue is applied, and the blank is folded along transverse fold lines to bring the various panels into the proper overlapping relationship.

It is a particular advantage of the present design that the central reinforcing panel adjacent the bights overlies the folded retaining tabs to hold them in the folded position before the carrier is erected. When the carrier is erected, the lift tabs positively lift the reinforcing tabs on the carton bottom to their operative position. The upper retaining tabs spring to an operative position on their own because of the natural resilience of the material and the geometry of most glassware at its upper, open end.

DESCRIPTION OF PREFERRED EMBODIMENTS OF THE INVENTION

Figure 1:
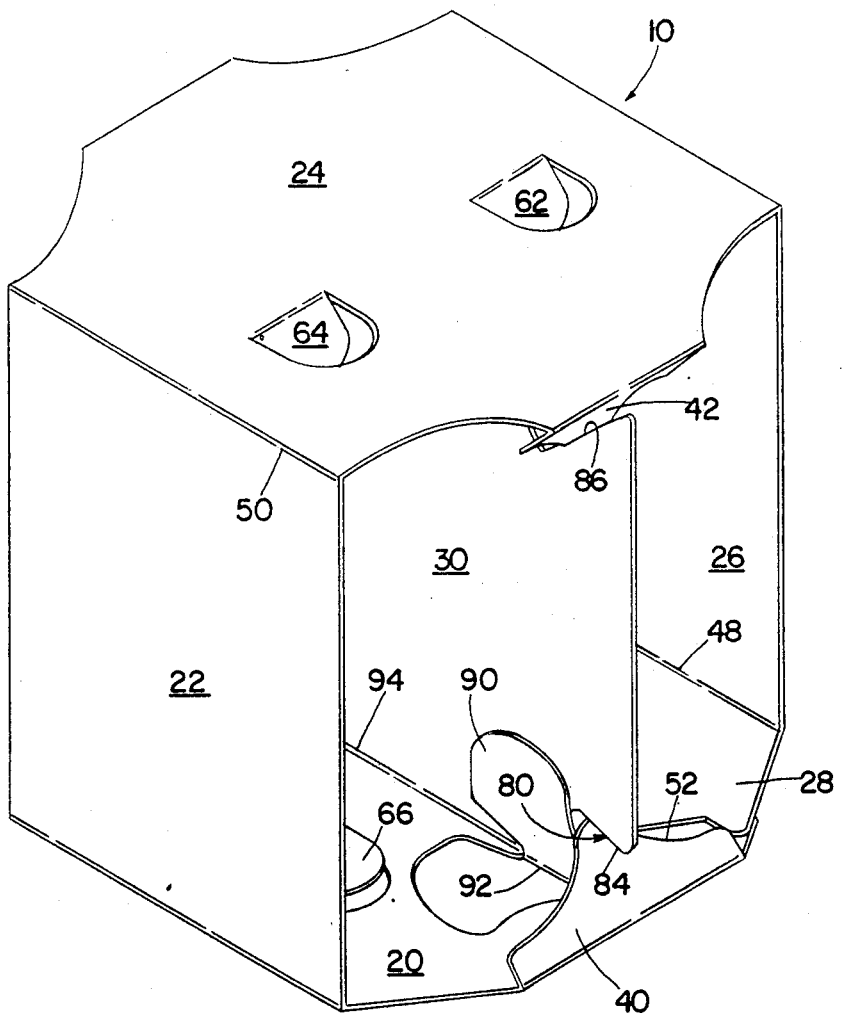
FIG. 1 is a perspective illustration of a carrier constructed in accordance with the present invention.
Figure 2:
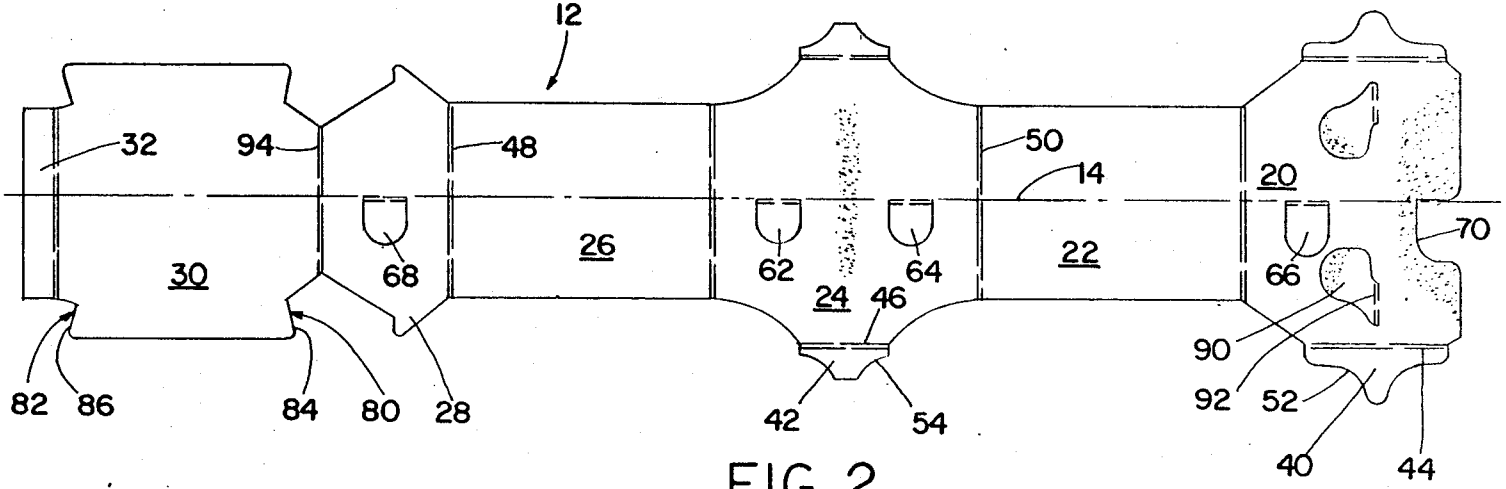
FIG. 2 is a plan view of a blank from which the carrier of FIG. 1 may be formed.

The carrier 10 shown in FIG. 1 is formed from a cardboard blank 12 illustrated in FIG. 2 on a conventional folding machine. The blank 12 is essentially symmetrical about its longitudinal center line 14, and accordingly only the front half of the blank 12 and carrier 10 will be described in detail. The asymmetries are specifically noted when appropriate.

The blank 12 includes (from right to left in FIG. 2) a bottom panel 20, a left side panel 22, a top panel 24, a right side panel 26, an overlap panel 28, a central reinforcing panel 30, and a glue flap 32. Each panel (and the glue flap) is connected to its adjacent panel or panels by creased fold lines which are perpendicular to the center line 14.

The blank 12 also includes retaining tabs 40 and 42 which extend from the bottom panel 20 and the top panel 24, respectively. The retaining tabs 40 and 42 are connected with their respective panels along creases or fold lines 44 and 46 which are parallel to the center line 14. The fold lines 44 and 46 also happen to be colinear with each other, but this is because the carrier 10 is designed for glassware that has a top and bottom of about the same diameter. When the glassware has a substantially non-cylindrical shape the fold lines 44 and 46 could be non-colinear.

When in their operative positions (shown in FIG. 1), the retaining tabs 40 and 42 are effective to prevent the accidental or unintentional removal of glassware from the carrier 10. For this purpose, each tab 40 and 42 has a contour along its free edge 52, 54, respectively, which matches the contour of the glassware for which the carrier 10 is intended.

Figure 3:
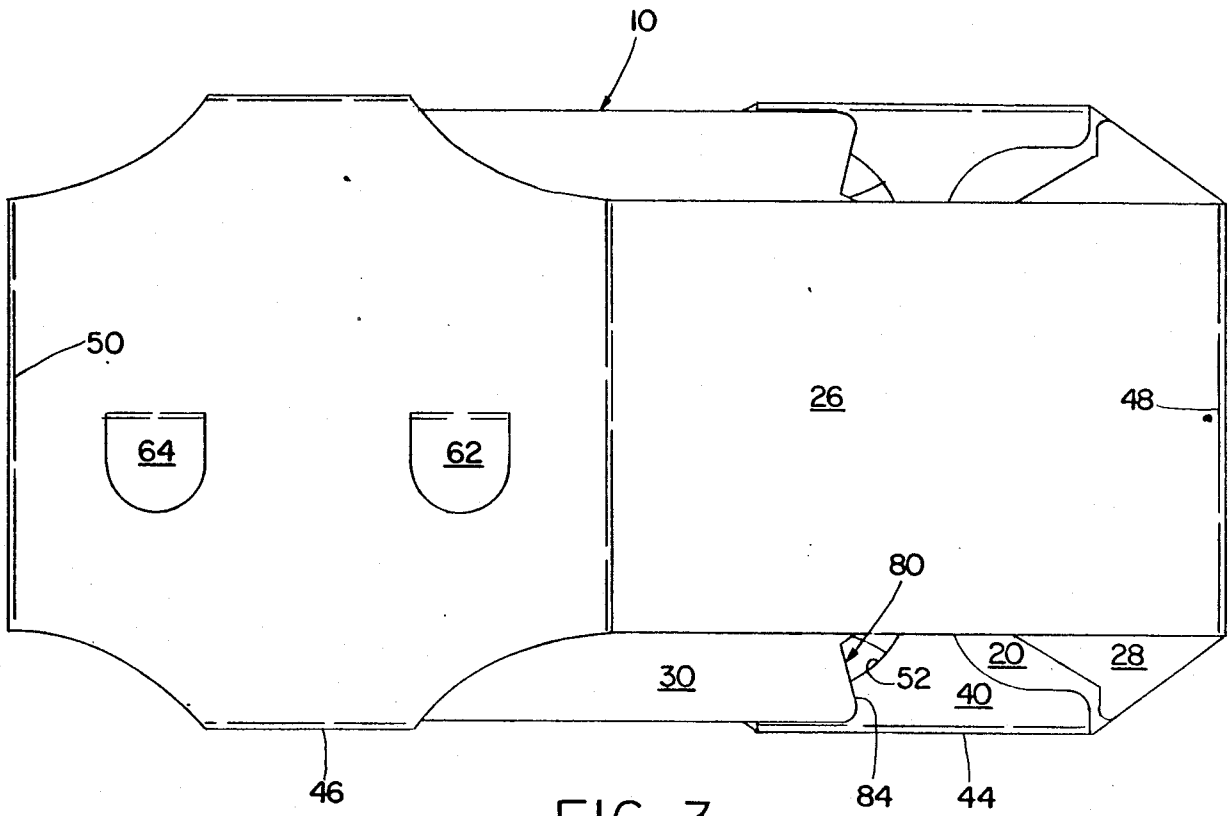
FIG. 3 is a plan view of the carrier of FIG. 1 in a collapsed condition.
Figure 4:
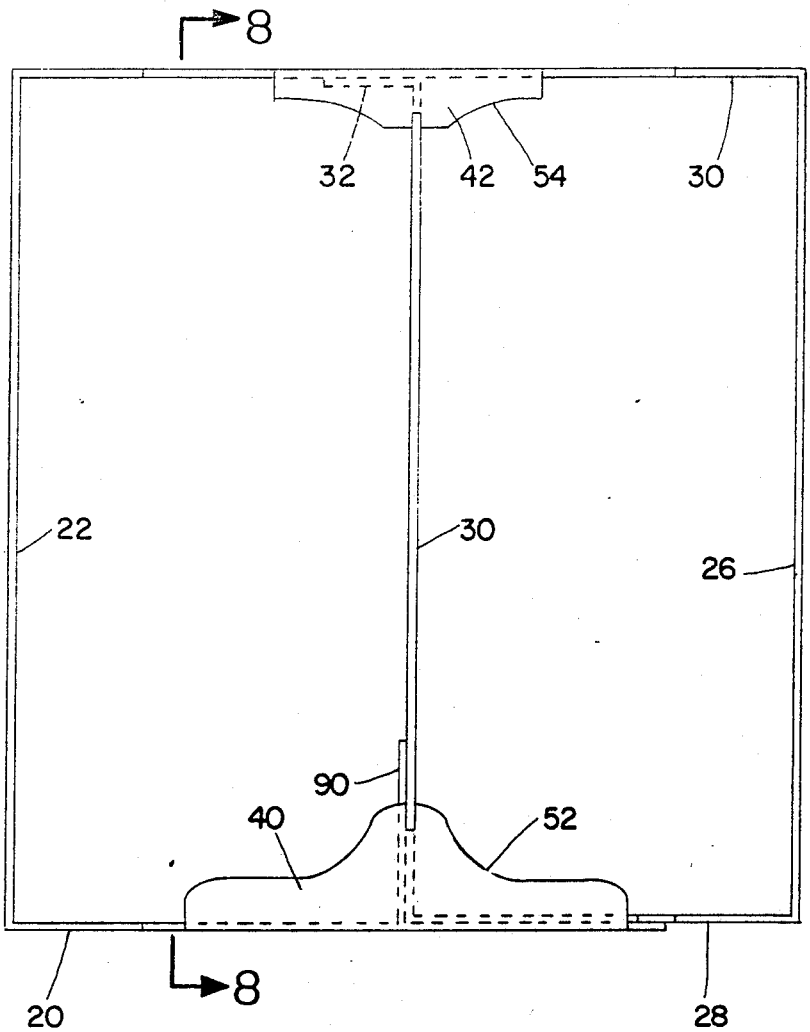
FIG. 4 is a front elevation view of the carrier of FIG. 1.

The carrier 10 is formed by first folding the retaining tabs 40 and 42 180° about the fold lines 44 and 46 until the tabs lie flat against their respective panels 20 and 24. Next, glue is applied to the areas shaded in FIG. 2 and the blank is then folded successively first about transverse fold line 48 and then about transverse fold line 50. These steps produce the collapsed carrier 10 shown in plan view in FIG. 3.

The carrier 10 may then be erected to the configuration shown in FIG. 1 by grasping the carrier and pressing the fold lines 48 and 50 toward each other. The result is the carrier 10 shown in FIG. 1 which defines a sleeve with the central reinforcing panel 30 dividing the carrier vertically in half.

Figure 7:
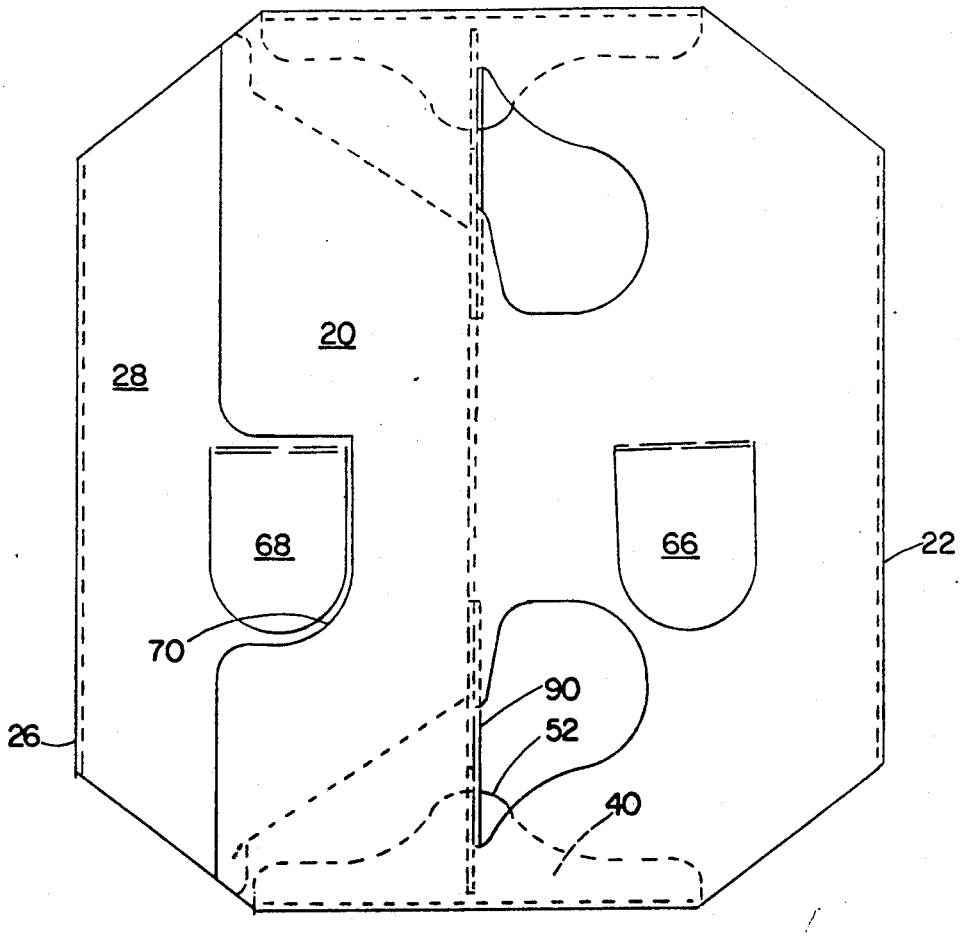
FIG. 7 is a bottom view of the carrier of FIG. 1.

The carrier 10 is proportioned to hold four glasses, two on each side of the central dividing panel 30, and this accounts for the only asymmetry of the blank 12 (FIG. 2). Tabs 62, 64, 66, and 68 are die cut into the top, bottom, and overlap panels 24, 20, and 28, respectively. These tabs are D shaped and hinged along creases which are coincident with the center line 14. When folded into the carrier 10 (FIG. 1) so that the plane of each tab is perpendicular to the panel to which it is hinged, the tabs prevent adjacent glasses on the same side of the central reinforcing panel 30 from clinking against each other. To permit a worker to push tab 68 out of the plane of the overlap panel 28, a cutout 70 (FIGS. 2 and 7) is formed in the edge of the bottom panel 20.

Figure 5:
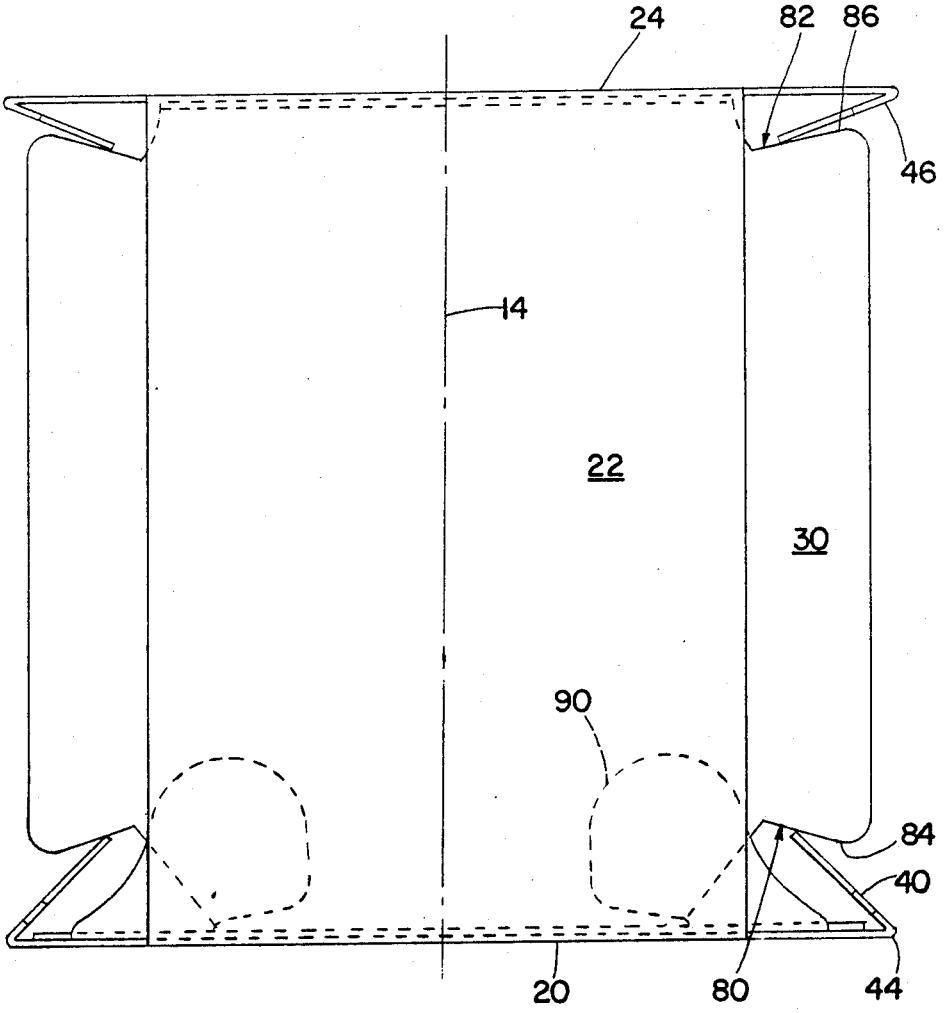
FIG. 5 is a left side elevation view of the carrier of FIG. 1.
Figure 6:
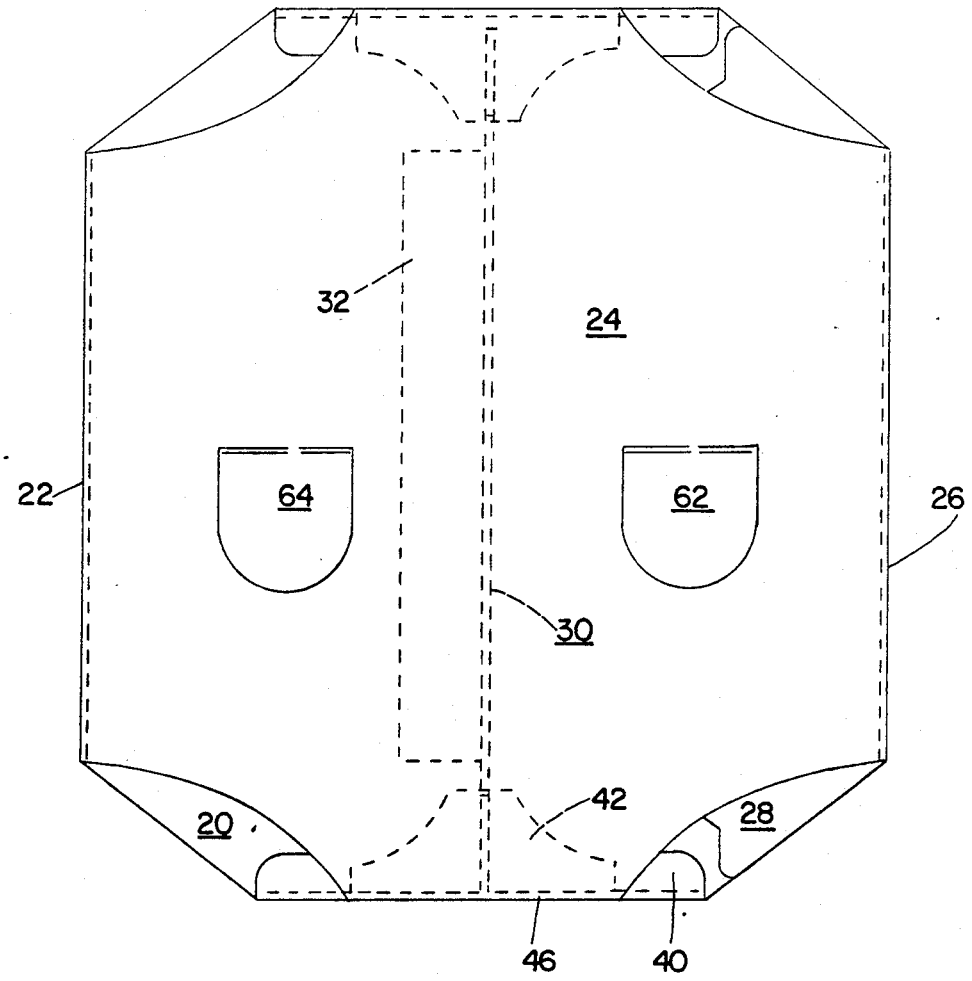
FIG. 6 is a top plan view of the carrier of FIG. 1.
Figure 8:
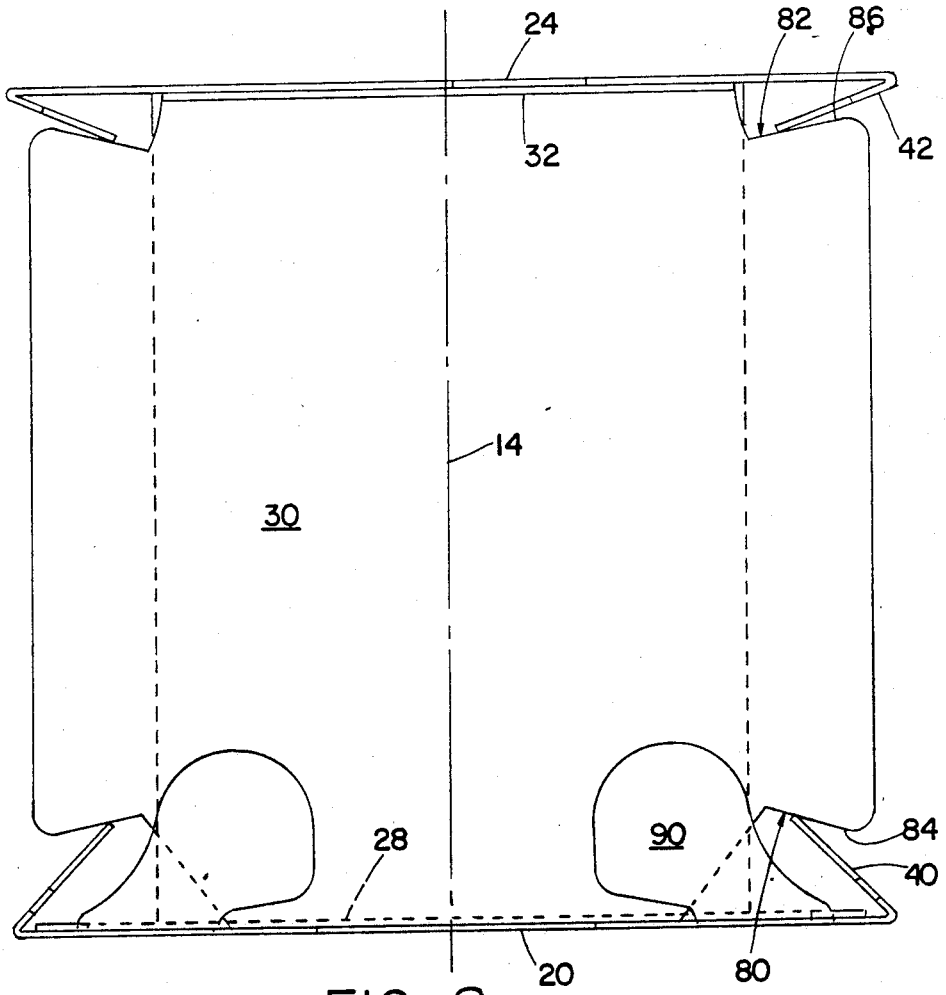
FIG. 8 is a section view looking generally in the direction of arrows 8—8 of FIG. 4.

The carrier 10 includes a unique arrangement and cooperation between the retaining tabs 40 and 42 and the bights 80 and 82 in the central reinforcing panel 30 with which the tabs 40 and 42 cooperate, respectively. After the carrier 10 is erected, each tab 40 and 42 contacts a straight line edge 84 and 86, respectively, which partially defines the respective bight. See FIGS. 1, 5, and 8. In this position the tabs 40 and 42 are effective to prevent withdrawal of a glass from the carrier 10.

The bights 80 and 82 are also shaped to facilitate assembly and erection of the carrier 10. When the blank 12 is first folded along fold lines 48 and 50, the resultant carrier is a flat, three-layer sandwich. Specifically, the right side panel 26 and the top panel 24 are coplanar (FIG. 3), the bottom panel 20 and left side panel 22 are also coplanar, and the central reinforcing panel 30 and overlap panel 28 are coplanar and sandwiched between the other four panels. When the carrier 10 is in the flattened position shown in FIG. 3, the edge 84 of the bight 80 in the central reinforcing panel 30 overlaps the contoured edge 52 of the retaining tab 40. At the same time the edge 86 of the bight 82 overlaps the contoured edge 54 of the retaining tab 40 in the same manner.

As noted above, the first step in folding the blank 12 to form the carrier 10 is to fold the retaining tabs 40 and 42 180. about fold lines 44 and 46. The tabs 40 and 42 are held in this position while the blank is bent about transverse fold lines 48 and 50. The overlapping by the central reinforcing panel 30 described above holds the retaining tabs 40 and 42 folded over until the carrier is erected. When the carrier 10 is erected from the collapsed state (FIG. 3) to the erect state (FIG. 1), the natural resilience of the cardboard causes the retaining tabs 40 and 42 to unfold slightly from being flat upper retaining tab 42 to cause it to catch the edge of a glass and prevent the glass' removal.

The lower retaining tab 40 may not spring up from its folded flat arrangement to engage the bottom of a glass inserted in the carrier 10, depending on the shape of the glass. In order to ensure that the tab 40 unfolds satisfactorily, a lift tab 90 is provided.

The lift tab 90 is die cut from the bottom panel 20 and is shaped to fold along a transverse fold line 92. When the blank 12 is folded, the fold line 94 between the overlap panel 28 and the central reinforcing panel 30 aligns with the fold line 92. Glue previously applied to the tab 90 bonds the tab 90 to the central reinforcing panel.

When the carrier 10 is erected, the central reinforcing panel 30 pivots from being parallel to the bottom panel 20 to being perpendicular to it. Part of the lift tab 90 is underneath the retaining tab 40 when the carrier 10 is in the collapsed condition. Lifting the tab 90 by pivoting it about fold line 92 causes it to lift the retaining tab to an operative position where it will engage a glass and prevent its removal. Thus the act of erecting the carrier 10 pries the tab 90 out of the plane of the bottom panel, and brings it to a perpendicular position.

A lift tab like lift tab 90 could also be provided to ensure proper positioning of the retaining tab 42, but it is generally not necessary because glassware generally has cylindrical side walls, near the open, top end. The lift tab 90 to position the lower retaining tab 40 is necessary because of the curved contour of the lower portion of the glassware which requires greater angular movement of the retaining tab 40 from its folded flat position.

When the carrier 10 is manufactured in automatic folding equipment, the creases along fold lines 44 and 46 may be compressed between rollers so firmly that the natural resilience of the cardboard does not allow the retaining tabs 40 and 42, respectively, to spring upward naturally. The lift tab 90 resolves this problem with respect to the lower retaining tab 40. Gravity and the slight remaining resilience of the top retaining tab 42 are sufficient to cause the upper retaining tab 42 to fall down into a glass engaging position.

To increase the resilience of the cardboard along fold lines 44 and 46, the pressure applied by the rollers in the folding machine can be reduced so that less of the cardboard is crushed at the fold. Alternatively, a lift tab like tab 90 could be provided for the upper retaining tab 42.

Accordingly, it is clear that the display carrier 10 is substantially easier to use than the prior art display carriers. The carrier 10 is formed from a unitary, planar cardboard blank 12 (FIG. 2) which is die cut and folded in a conventional folding machine to form the carrier 10. The locking tabs 40 and 42 require no manual manipulation because they automatically position themselves as the carrier 10 is erected. The central reinforcing panel has bights 80 and 82 and retaining tabs 40 and 42 which are associated with the respective one of the bights. The retaining tabs 40 and 42 are hinged to the bottom and top panels, 20 and 24, respectively. The retaining tabs 40 and 42 hinge outward in their respective panels and press against the straight surfaces 84 and 86 of the bights 80 and 82, respectively to block any outward movement of a glass inside the carrier. Lift tabs 90 positively elevate the lower retaining tab 40.

What is claimed is:

1. A display carrier foldable from a generally flat collapsed condition for shipping and storage to an erect position for retaining at least a pair of articles, said carrier being formed of a flexible material and comprising top and bottom walls;

a pair of side walls, each side wall being hingedly attached to each of said top and bottom walls, to form a carrier sleeve;

a reinforcing wall extending between and hingedly a planar retaining tab resiliently connected along a fold line to one of the top and bottom walls and having a single contoured edge joining opposite ends of the fold line, the contoured edge being shaped to engage a portion of the surface of the retained articles;

the reinforcing wall having a tab-receiving bight at one end portion of the reinforcing wall and adapted to limit rotation of the tab about the fold line in one direction when the carrier sleeve is in the erect position;

the sleeve being foldable along the hinged connections between the top, bottom, side and reinforcing walls between a collapsed condition for storage in which the walls are generally parallel and the reinforcing wall holds the tab flattened against the one of the top and bottom walls to which the tab is connected and an article receiving position in which the tab extends angularly along its fold line toward the interior of the carrier sleeve and abuts the bight in the retaining wall.

2. The carrier of claim 1 including lift tab means for lifting the tab from its flattened condition as the sleeve is folded from the collapsed condition to the article receiving position.

3. The carrier of claim 2 wherein the tab means is hingedly connected with the bottom wall.

4. The carrier of claim 3 wherein the tab means is attached to the central dividing panel.

5. The carrier of claim 1 wherein the tab includes a contoured surface to match the profile of articles to be carried in the carrier.

6. The carrier of claim 1 including a pair of retaining tabs hinged to opposite edges of one of the top and bottom panels.

7. The carrier of claim 1 including four retaining tabs each hinged to an edge of one of the top and bottom retaining walls.

8. The carrier of claim 6 wherein the reinforcing wall has a pair of bights, one associated with each of the tabs, and the reinforcing wall adjacent the bights holds the tabs folded flat against their respective top or bottom wall when the carrier is in the collapsed condition.

9. The carrier of claim 8 including lift tab means for lifting at least one of the retaining tabs from the folded flat position as the carrier is folded from the collapsed condition to the article receiving position.

10. A method of making a carton from a longitudinally extending blank having creases defining first, second, third, fourth, fifth, and sixth fold lines, all parallel to each other and transverse to the longitudinal axis of the blank to define a glue flap, and central, overlap, left side, top, right side and bottom panels, the top panel having transversely extending top retaining tabs extending therefrom and defined by longitudinal fold lines, the central panel having bights formed in the free, longitudinal edges thereof; the method comprising the steps of first folding the retaining tabs about the longitudinal fold lines until a surface of each tab is folded flat against a surface of the top panel, folding the blank about one of the transverse fold lines to bring a surface of the central panel which is adjacent a bight in contact with each top retaining tab to hold said tab in a folded condition, and thereafter folding the blank about another of the fold lines.

11. The method of claim 10 wherein the blank includes a pair of transversely extending bottom retaining tabs hinged to the bottom panel about longitudinal fold lines and including the steps of folding the bottom retaining tabs about their respective fold lines to bring the bottom retaining tabs flat against the bottom panel and thereafter folding the blank about another one of the fold lines to bring a surface of the central panel which is adjacent a bight into contact with each bottom retaining tab to hold said tabs in a folded position.

12. The method of claim 10 including the step of gluing the glue flap to one of the panels after folding said blank about said one of said fold lines.

13. The method of claim 11 including holding the areas of the central panel which contact the retaining tabs in tight contact therewith by gluing said glue flap to one of the panels of the blank.

14. The method of claim 13 wherein the step of folding about one of the fold lines includes folding about the third fold line.

15. The method of claim 14 wherein the step of holding the areas of central panel which contact the retaining tabs includes gluing the glue flap to the top panel.

16. The method of claim 14 wherein the step of folding about another of the fold lines includes the step of folding about the fifth fold line.

17. The method of claim 16 including erecting the carton by pressing the third and fifth fold lines toward each other.

18. The method of claim 17 including moving at least one of the top and bottom retaining tabs from its folded flat position to a position in which the retaining tab is angled to the surface from which it extends.

19. The method of claim 18 wherein the step of moving includes lifting a lift tab out of the plane of one of the bottom and top panels as the third and fifth fold lines are pressed toward each other.

20. The method of claim 19 wherein the step of lifting the lift tab includes gluing the lift tab to the central panel.

21. The carton made according the method of claim 11.

22. A collapsible cardboard carrier for glassware comprising two generally vertical side panels, generally horizontal top and bottom panels interconnecting the two side panels, a retaining tab extending from a free edge of one of the top and bottom panels, and a vertical reinforcing panel extending between the top and bottom panels, the vertical reinforcing panel having a bight to cooperate with the retaining tab, the carrier being shiftable between:

a first position in which the top and one side panel are substantially coplanar defining a first plane, the bottom and other side panel are coplanar and parallel to the first plane, the retaining tab is folded and superimposed against the panel from which it extends, and the central reinforcing panel holds the retaining tab folded and superimposed against the panel from which it extends, and a second, erect position in which the reinforcing panel is generally perpendicular to the one of the top and bottom panels from which the retaining tab extends and the retaining tab is received in the bight.

23. The carrier of claim 22 including a lift tab hinged along a fold line to one of the top and bottom panels and having a portion glued to the vertical reinforcing panel, the lift tab moving out of the plane of the panel to which it is hinged as the carrier shifts from the first to the second position.

24. The carrier of claim 23 wherein the lift tab is positioned to make sliding contact with an edge of the retaining tab as the carrier moves from the first to the second position.

* * * * *